United States Patent [19]

Hibsch

[11] Patent Number: 5,057,067

[45] Date of Patent: Oct. 15, 1991

[54] METHOD OF MAKING A PAPER SPINNING WHEEL PRODUCT

[75] Inventor: Susan Hibsch, Woodridge, Ill.

[73] Assignee: The Lehigh Press, Inc., Cherryhill, N.J.

[21] Appl. No.: 575,273

[22] Filed: Aug. 30, 1990

[51] Int. Cl.[5] ..... B31B 1/62; B31B 1/88

[52] U.S. Cl. ..... 493/325; 283/65; 434/198; 434/404

[58] Field of Search ..... 283/65, 117; 434/198, 434/208, 215, 404; 493/325, 216, 222, 944, 959

[56] References Cited

U.S. PATENT DOCUMENTS

| | | | |
|---|---|---|---|
| 1,728,584 | 9/1929 | Wright | 434/198 |
| 2,792,993 | 5/1957 | Schramm | 434/198 X |
| 3,025,767 | 3/1962 | Ruffalo | 493/325 |
| 3,419,973 | 1/1969 | Manotas et al. | 434/198 |
| 3,523,376 | 8/1970 | Gillian et al. | 434/198 |
| 4,262,939 | 4/1981 | Schoettle, Jr. | 283/65 |
| 4,626,220 | 12/1986 | Kaufman et al. | 434/404 X |

*Primary Examiner*—Joseph M. Gorski
*Assistant Examiner*—Peter Dungba Vo
*Attorney, Agent, or Firm*—Trexler, Bushnell, Giangiorgi & Blackstone

[57] ABSTRACT

A spinning wheel type paper product and a method of fabricating the same from a single continuous web of material. The method comprises the steps of cutting the web of material to define a window and a wheel having a central aperture and slitting the web into two ribbons, one of the ribbons including said window and the other including said wheel. An area of glue is applied to the ribbon carrying the window at a location spaced apart from the window and the ribbons are stacked in a position for aligning the central aperture with the glue area. The ribbon carrying the window is folded over so as to enclose the ribbon carrying the wheel and such that the area of glue extends through the central aperture in the wheel to adhesively secure, with a facing surface of the window carrying ribbon, the other side thereof. Individual products are then formed by transversely cutting the web.

8 Claims, 3 Drawing Sheets

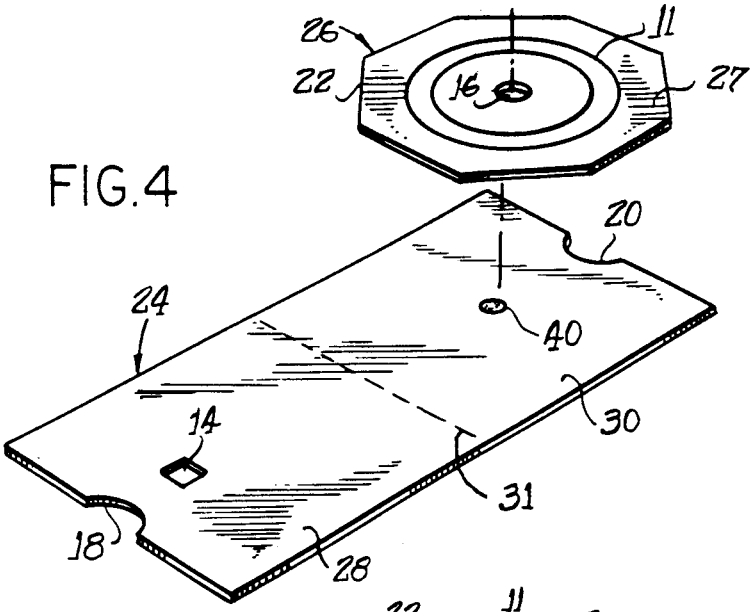
FIG.4
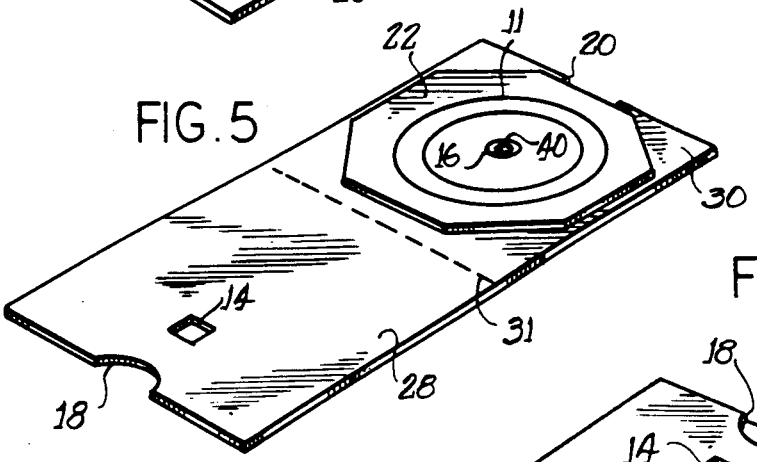
FIG.5
FIG.6
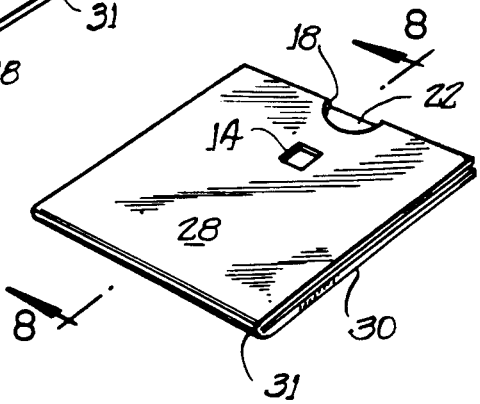
FIG.7
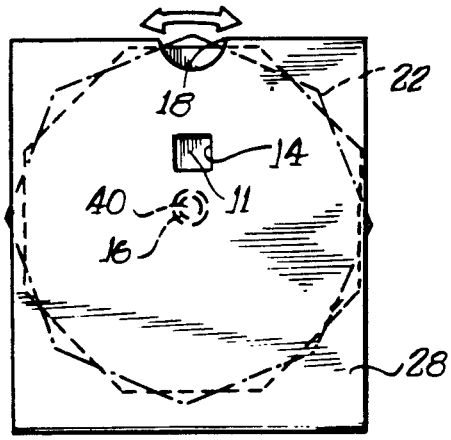
FIG.8
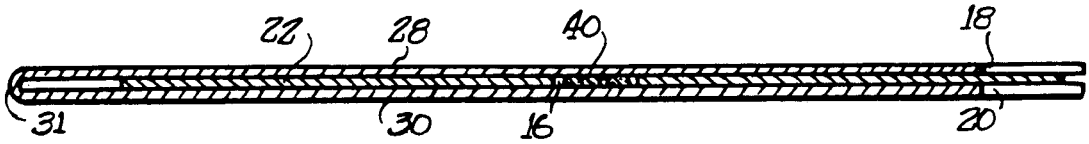

METHOD OF MAKING A PAPER SPINNING WHEEL PRODUCT

BACKGROUND OF THE INVENTION

This application relates generally to a spinning wheel type of paper product and to a method for making such a product.

Generally speaking, a spinning wheel paper product is a construction in which an internal rotatable wheel-like member may be manipulated to expose a selected printed portion thereon through one or more window openings in a face and/or base panel portion of the construction. As such, the wheel portion is generally carried between the face portion and a base portion of the construction.

Various specialty products such as pop-up products and spinning wheel products are used in various promotional applications. For example, greeting cards as well as advertising-type material utilize various types of spinning wheel arrangements to enhance appeal to the purchasing public and/or to advertisers. Often, such advertisements are carried as inserts in newspapers, magazines and periodicals or in advertising brochures, catalogs or the like. While the fabrication of such items may take various forms, it is particularly desirable to minimize the cost thereof and maximize the speed at which such items may be fabricated and printed. Preferably, the printing and fabrication of such a spinning wheel type item takes place in a single press run; that is, on one pass through a single line of equipment.

It is also preferable that the spinning wheel type item be fabricated from an initial single web of material, such as from a single roll of a roll-type paper stock material, which can be readily and conveniently fed in one pass through the necessary printing and forming machinery as a continuous web and at fairly high speed. The cutting of the web into the individual, fully-formed items generally comprises the final step in such a one-pass fabrication procedure. Thereupon the individual items may be suitably stacked or collated for packaging, or for insert use, as desired.

Such single pass operations, utilizing a single web from a roll or the like may proceed at a relatively high speed, often approaching thousands of pieces per hour, to thereby maximize the production and minimize the cost of such items.

OBJECTS AND SUMMARY OF THE INVENTION

It is a general object of this invention to provide a novel and improved spinning wheel paper product and an improved method of making the same.

A related object is to provide a spinning wheel paper product and method of making the same wherein the product may be fabricated in a single pass type of operation from a single continuous web.

Briefly, and in accordance with the foregoing objects, a spinning wheel product, fabricated from a single continuous web of material comprises a base panel, a face panel extending to one side and folded over said base panel and having at least one window formed therein, a wheel panel placed between said base panel and said base panel and having a central aperture and an annular area defined thereon and a glue area for contacting and engaging the base panel and the face panel through the central aperture in the wheel panel so as to rotatably engage the wheel panel therebetween and align the annular area of the wheel panel with the window formed in the face panel.

A method of fabricating a spinning wheel type paper product from a single continuous web of material comprises the steps of cutting the web of material to define at least one window opening and a wheel having a central aperture, slitting the web into two ribbons, one of the ribbons including the window opening and the other ribbon including the wheel, applying an area of glue to the ribbon carrying the window at a location spaced apart from the window, stacking the two ribbons in a position such that the central aperture of the wheel and the area of glue are in alignment, folding the ribbon carrying the window opening onto itself so as to adhesively secure opposing surfaces thereof with the area of glue extending through the central aperture in the wheel thereby enclosing the ribbon carrying the wheel. Finally, separating the web of material into individual products, preferably by a rotary cutting operation.

BRIEF DESCRIPTION OF THE DRAWINGS

The features of the present invention which are believed to be novel are set forth with particularity in the appended claims. The organization and manner of the operation of the invention, together with further objects and advantages thereof may best be understood by reference to the following description, taken in connection with the accompanying drawing in which like reference numerals identify like elements, and in which:

FIGS. 4 and 5 illustrate a stacking step or operation with the two ribbons formed pursuant to the slitting operation of FIG. 3, and the application of an area of glue to one of the ribbons previously formed and stacked;

FIG. 6 illustrates the step of folding of one ribbon to enclose the other ribbon;

FIG. 7 illustrates the completed spinning wheel product in elevation;

FIG. 8 is a sectional view taken generally along the line 8—8 of FIG. 6.

DETAILED DESCRIPTION OF THE ILLUSTRATED EMBODIMENT

Figure 9:
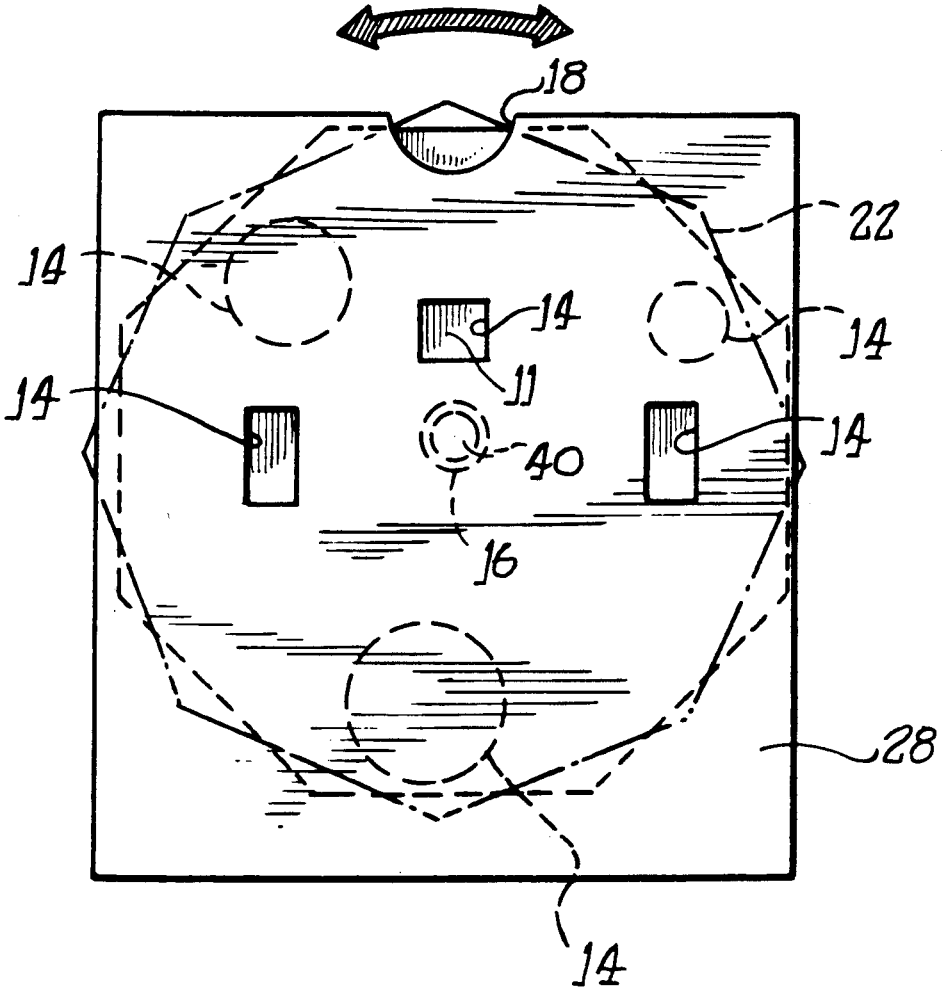
FIG. 9 illustrates an alternate embodiment of the completed spinning wheel product.

Referring to the drawings, and initially to FIGS. 1–6, a method of fabricating a spinning wheel type of product in accordance with the invention will be described. The completed product, constructed in accordance with the method of the invention, is also shown in FIGS. 7 and 8, to which reference will be had later herein. FIG. 9 illustrates another embodiment of the completed product.

Figure 1:
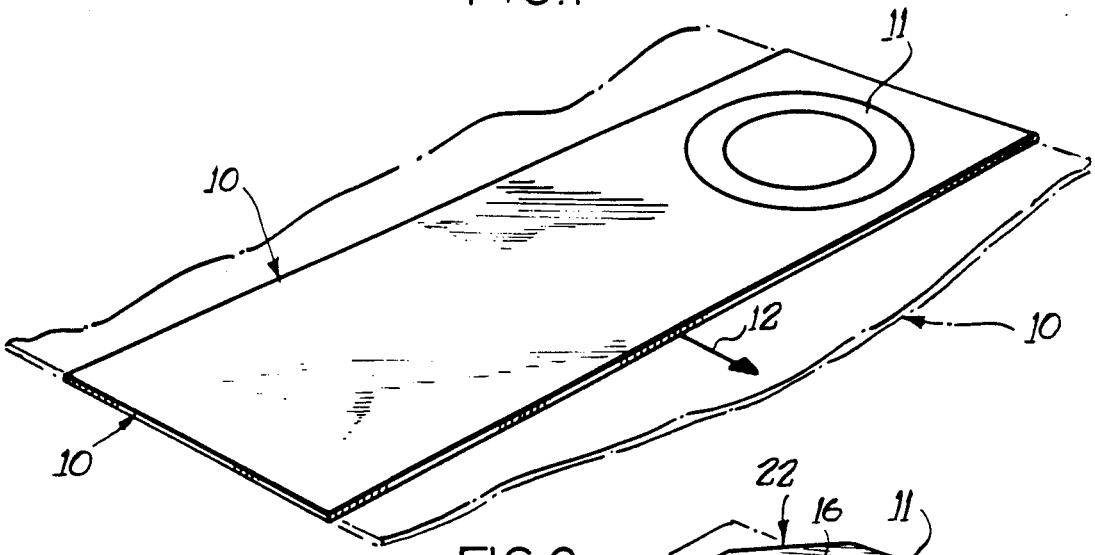
FIG. 1 is a perspective view of a segment of a continuous web of material from which a spinning wheel product in accordance with the invention may be fabricated.

Referring to FIG. 1, a method of fabricating a spinning wheel product in accordance with the invention includes the fabrication of the product from a single continuous web of material designated generally by the reference numeral 10. This web of material will be understood to be continuous, such that only a single segment thereof is illustrated in FIG. 1. The direction of movement of the material 10 through apparatus for processing the same into a more or less continuous stream of like products is indicated generally by the reference numeral 12. It will be understood that the web segment or portion illustrated in FIG. 1 is but a part of an elongate continuous web of material such as paper or paper-like product which may be carried on a roll, to be fed in direction 12 through a continuous line of equipment for fabricating a continuous series of like products from the web 10 end to end in a one-pass operation. It should also be obvious to one of ordinary skill in this art that the width of the initial web 10 may be subdivided into two or more ribbons of paper or the like, resulting in multiple streams of product production. The continuous nature of web 10 is indicated in broken line in FIGS. 1-3. This showing has been omitted in the remaining drawings to facilitate clarity.

Initially, any printed material to be included on a finished product will be printed upon the desired locations on the web 10. As will be seen later, these desired locations include a generally annular area 11, the significance of which will become apparent hereinbelow.

Figure 2:
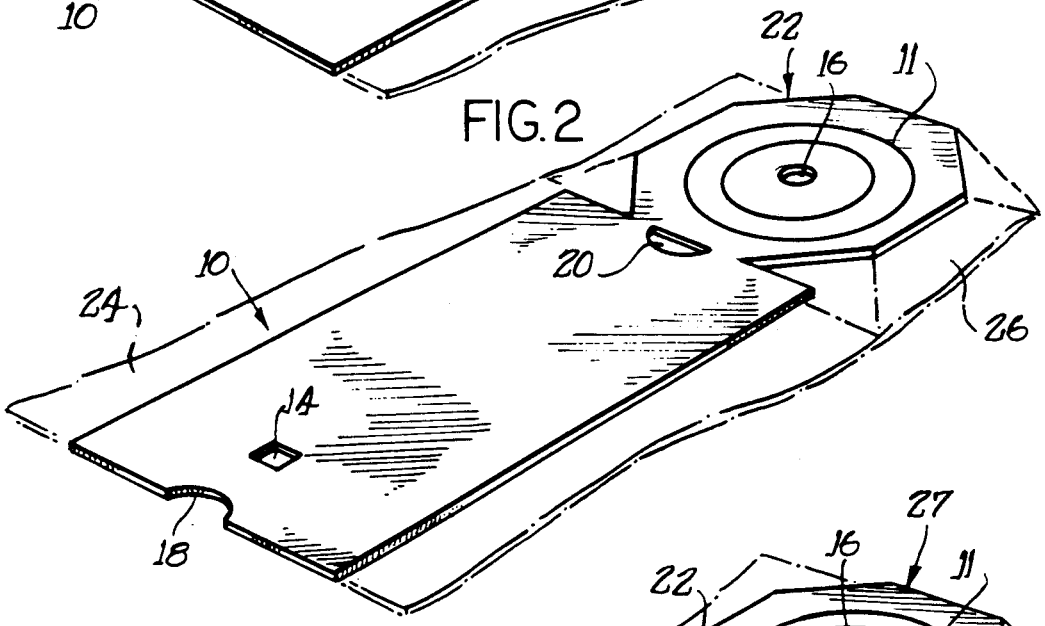
FIG. 2 is a perspective view of the web of FIG. 1 illustrating a die cutting step or operation.

Thereafter, and referring next to FIG. 2, a cutting operation, preferably in the form of a die-cutting operation, is utilized to form cutout portions or window openings on the web 10. It will be understood in this regard that FIGS. 2-6 illustrate the formation of but a single spinning wheel type product on the illustrated portion or segment of the web 10; however, the process is continuous so that a plurality of identical products will be formed in end-to-end fashion on the continuous web 10. It should also be understood in this regard that FIGS. 2-6 illustrate the formation of a spinning wheel product having only a single window opening 14, and that multiple window openings can easily be formed if desired. As is further discussed below, forming multiple window openings will result in an alternate embodiment as illustrated in FIG. 9.

Accordingly, in FIG. 2, the die-cutting operation forms a first through-opening or window 14, which is located generally toward a first end of the web and a second through-opening or aperture 16 which is located toward an opposite end of the web from window 14. The die-cutting operation also defines a wheel member 22 upon which aperture 16 forms a central through-opening, and upon which the annular area 11 is substantially coaxially aligned with the aperture 16. This wheel member 22 is shaped for aligning annular area 11 with window 14 when the product is completed as will be described further hereinbelow.

Preferably additional edge cutouts or thumb tab-shaped cutouts 18, 20 are also formed in appropriate portions of the web. As will be seen later, the thumb tab cutouts permit gripping and manipulating of the wheel portion of the finished product in use.

Figure 3:
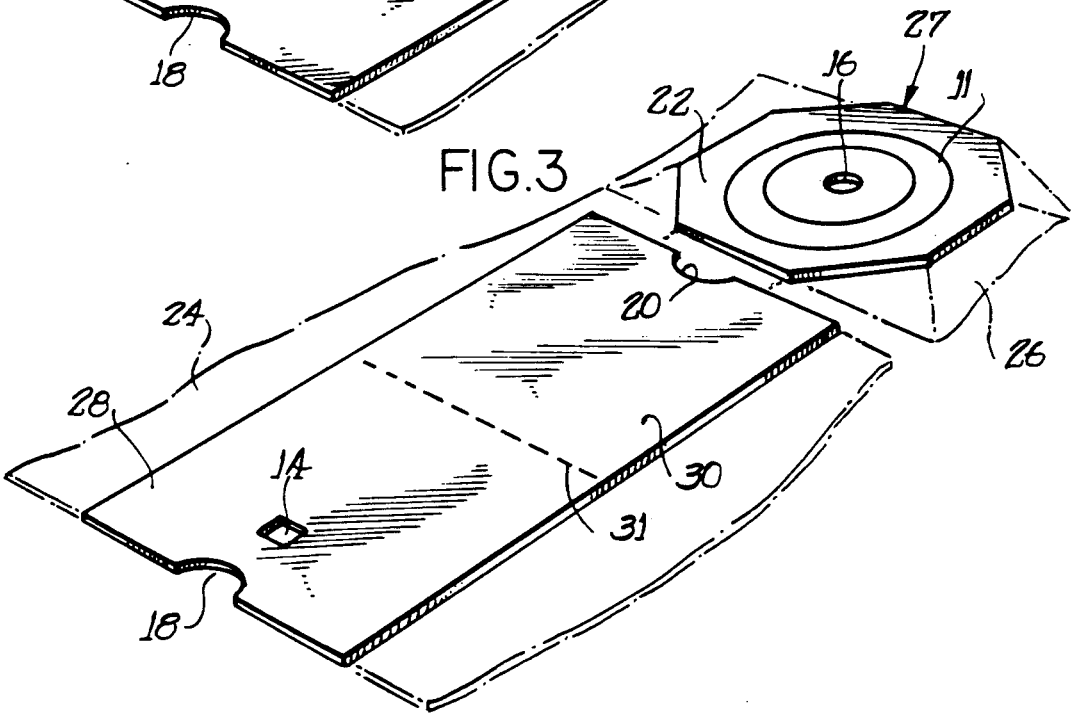
FIG. 3 illustrates a slitting step or operation on the web of FIGS. 1 and 2.

Referring next to FIG. 3, the method proceeds by slitting the web 10 into two ribbons 24, 26; the ribbon 24 including the window 14 and the ribbon 26 including the wheel 22. As will be more fully appreciated later, the formation of the thumb tab cutouts 18 and 20, of the window 14, and of the wheel 22, and the slitting of the two ribbons generally define three panels on the two ribbons 24, 26. One of these panels, designated as the wheel panel 27, is defined on the ribbon 26. A second panel, which will be called the face panel 28, is that area or portion which carries the window 14. A third panel, which will be referred to as the base panel 30, extends generally to one side of the face panel 28, and is defined by a fold line 31. The wheel panel 27 generally extends from a side of the base panel 30 opposite face panel 28, prior to severing or slitting the wheel panel 27 therefrom as illustrated in FIG. 3.

Referring to FIGS. 4 and 5, the method next proceeds by stacking the ribbons in position for aligning the wheel member 22 in such a position that it will later be alignable for rotation of the annular area 11 relative to the window 14. This initially involves aligning ribbons 24, 26 such that the wheel panel 27 is immediately over and in alignment with the base panel 30. As indicated above, the base panel 30 and face panel are separated by a fold line 31 therebetween along which the panels 28, 30 will be folded later. With the wheel panel 27 aligned with the base panel 30, a glue area 40 is deposited on the base panel 30 in alignment with central aperture 16 of wheel 22.

In FIG. 6, it will be seen that the aperture 16 is located and aligned such that the area of glue 40 will engage and adhesively secure against the surface of face panel 28 through the aperture 16, when the ribbon 24 which carries the window 14 is next folded over upon itself to generally superimpose and align the face panel 28 with the base panel 30; that is, the ribbon 24 is folded along the fold line 31 previously defined and identified. This folding over partly encloses the ribbon 26; that is, the ribbon 26 is enclosed at its top and bottom surfaces and at its lateral edge which is aligned with the fold line 31 as viewed in FIG. 6. Again, at this point, the glue area 40 will extend through the aperture 16 to contact and adhesively secure with the facing surfaces of the ribbon 24 and form an axis or hub about which the wheel 22 may be rotated.

Finally, individual spinning wheel products, which have been formed from the continuous web 10 are separated, as by a rotary cutter, as can be envisioned by reference to FIGS. 6 and 7.

In FIGS. 7 and 8, it will be seen that the wheel 22 is appropriately shaped and located for rotation of annular area 11 for selective viewing relative to the window 14 when the product is fabricated by the method described hereinabove.

FIG. 9 shows an alternate embodiment of the spinning wheel type product which includes additional window openings 14 formed in both the face panel 28 and base panel 30. It should be obvious that for this construction, printing on both sides of the wheel ribbon 26, and that larger, and/or additional annular areas 11 would be desirable to permit viewing of printed material through the windows 14. The additional windows 14 can also be utilized to facilitate manual rotation of the wheel 22.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. A method of fabricating a plurality of individual spinning wheel paper products from a single continuous moving web of material comprising the steps of:

cutting said web of material, thereby producing at least one window opening and a wheel having a central aperture;

slitting said web into two ribbons, one of said ribbons including said at least one window opening and the other including said wheel;

applying an area of glue to the ribbon carrying said at least one window opening at a location spaced apart from said at least one window opening;

stacking said ribbons in a position such that said central aperture of said wheel and said area of glue are in alignment so that the area of glue extents through said central aperture;

positioning the other ribbon carrying said wheel onto the ribbon carrying the window opening;

folding the ribbon carrying said window opening onto the other ribbon carrying said wheel so that said area of glue extending through the central aperture in said wheel adhesively secures opposing surfaces of said ribbon carrying said window opening together, and thereby enclosing said other ribbon carrying said wheel therebetween; and separating the web of material into individual spinning wheel paper products having a wheel rotatable about said area of glue securing said opposing surfaces of said ribbon carrying said window opening together.

2. The method of claim 1, wherein said steps are performed in order.

3. The method according to claim 1, wherein the step of cutting further includes cutting at least one thumb tab cutout on said window-carrying ribbon for facilitating manual access and manipulation of said wheel.

4. The method of fabricating a spinning wheel type paper product from a single continuous web of material as recited in claim 1, further comprising an initial step of slitting the web of material into two or more subdivisions thereby creating multiple product fabrication streams.

5. The method of claim 1, further comprising the initial step of printing upon said web of material.

6. The method of claim 5, wherein said printing includes printing predetermined material in a generally annular pattern on said wheel, so as to be visible through at least one of said window openings as said wheel rotates.

7. The method of claim 1, wherein multiple window openings are formed in said web of material.

8. The method according to claim 7, wherein the cutting step comprises die cutting of said multiple window openings and said wheel.

* * * * *